US007056171B2

(12) United States Patent
Matsuda

(10) Patent No.: US 7,056,171 B2
(45) Date of Patent: Jun. 6, 2006

(54) PERSONAL WATERCRAFT

(75) Inventor: Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/746,762

(22) Filed: Dec. 23, 2003

(65) Prior Publication Data

US 2004/0154513 A1 Aug. 12, 2004

(30) Foreign Application Priority Data

Dec. 24, 2002 (JP) ..... 2002-372444

(51) Int. Cl.
*B63H 21/10* (2006.01)

(52) U.S. Cl. ..... 440/88 A

(58) Field of Classification Search ..... 114/55.53, 114/55.51; 440/88 A
See application file for complete search history.

(56) References Cited

U.S. PATENT DOCUMENTS

| | | | | |
|---|---|---|---|---|
| 4,984,528 | A * | 1/1991 | Kobayashi | 114/55.51 |
| 5,390,621 | A * | 2/1995 | Hattori et al. | 114/55.51 |
| 5,957,072 | A * | 9/1999 | Hattori | 114/55.57 |
| 6,425,789 | B1 * | 7/2002 | Nakase et al. | 440/88 R |
| 2002/0164906 | A1 * | 11/2002 | Nanami et al. | 440/1 |

* cited by examiner

*Primary Examiner*—Ed Swinehart
(74) *Attorney, Agent, or Firm*—Alleman Hall McCoy Russell & Tuttle LLP

(57) ABSTRACT

A water-jet personal watercraft comprises a body including a hull and a deck covering the hull from above, the body being configured to form an engine room inside thereof in which an engine is mounted, and the deck being provided with a first opening configured to guide air from outside into the engine room, and a steering handle provided on an upper portion of the body, the steering handle including a steering shaft having a base portion where the steering shaft intersects an upper surface of the deck, wherein the first opening is provided on the upper surface of the deck at a position defined between the base portion of the steering shaft and a substantially center position between a front end portion of the body and the base portion of the steering shaft.

13 Claims, 5 Drawing Sheets

PERSONAL WATERCRAFT

BACKGROUND OF THE INVENTION

1. Field of the Invention

The present invention relates to a water-jet propulsion personal watercraft (PWC). More particularly, the present invention relates to an air-guiding system configured to guide ambient air from outside the watercraft into a body of the watercraft.

2. Description of the Related Art

In recent years, water-jet propulsion personal watercraft have been widely used in leisure, sport, rescue activities, and the like. The personal watercraft comprises a body including a hull and a deck covering the hull from above, and is provided with a straddle-type seat mounted over the deck. An opening is formed in the deck below the seat and configured to communicate with an inside of the body. A space within the body below the opening forms an engine room.

An engine is mounted within the engine room and configured to drive a water jet pump that propels the watercraft. The personal watercraft is configured to take air into the engine room from outside the watercraft for use in the engine through a gap between the seat and the deck and a gap between a cover of a compartment provided on a front portion of the deck and the deck.

Both the gap between the seat and the deck and the gap between the cover of the compartment and the deck have a relatively small flow cross-sectional area of air, and it is therefore difficult to take in a large amount of air through these gaps. Especially when the engine is operating at a high speed, the air taken in from outside the body into the engine room may be insufficient, and hence the taken-in air within the engine may be correspondingly insufficient. Under this condition, the engine is incapable of achieving desired performance.

By providing a gap having a larger flow cross-sectional area, a larger amount of air can be smoothly taken in into the engine room. However, since the personal watercraft often travels in choppy water, the water tends to enter the engine room through such a gap. Thus, a need exists for a water-proofing structure.

SUMMARY OF THE INVENTION

The present invention addresses the above described condition, and an object of the present invention is to provide a personal watercraft capable of smoothly taking a large amount of air into an engine room to allow an engine to obtain sufficient air even when the engine is operating at a high speed, without providing an intricate water-proofing structure.

According to the present invention, there is provided a water-jet propulsion personal watercraft comprising a body including a hull and a deck covering the hull from above, the body being configured to form an engine room inside thereof in which an engine is mounted, and the deck being provided with a first opening configured to guide air from outside into the engine room, and a steering handle provided on an upper portion of the body, the steering handle including a steering shaft having a base portion where the steering shaft intersects an upper surface of the deck, wherein the first opening is provided on the upper surface of the deck at a position defined between the base portion of the steering shaft and a substantially center position between a front end portion of the body and the base portion of steering shaft.

In the above-described construction, a large amount of air can be guided smoothly into the body through the first opening. Since the first opening provided in the upper surface of the deck at the position closer to the handle is located at a substantially upper portion of the deck, it is possible to inhibit the water or water spray from entering the body.

The first opening has an upper edge portion shaped to protrude forward or upward from the upper surface of the deck as seen in a side view of the body. In this structure, a larger amount of air can be guided into the body.

The opening may be configured to open in the upper surface of the deck, and an edge portion of the opening is formed in the supper surface of the deck.

The opening may be configured to extend laterally relative to the body along a horizontal cross-section of the deck and shaped such that its width is larger than its height. Typically, the personal watercraft is restricted in height for the purpose of maintaining a stable attitude, and it is therefore difficult to increase the height of the opening to allow sufficient air to be guided into the body therethrough. Accordingly, by setting the width larger than the height as described above, the opening can have a larger flow-cross-sectional area so that air sufficient to allow the engine to operate properly can be guided into the body therethrough. Such an opening is suitable to the personal watercraft.

A compartment and a cover may be provided on a front portion of the deck, the compartment being formed by recessing the body inward, and the cover being attachable to open and close an entrance of the compartment. The first opening may be provided on the cover, and a second opening may be provided on the compartment, and may be configured to communicate with the first opening provided on the cover with the cover closed, to allow air flowing through the first opening to be guided into the engine room.

Typically, the personal watercraft is provided with a relatively large-sized compartment with a cover on a front portion of the deck for storing a life jacket, a glove, etc. With the above construction, a larger amount of air can be guided smoothly into the body easily in the personal watercraft provided with the compartment with the cover on the front portion of the deck.

The water-jet propulsion personal watercraft may further comprise an air-guiding passage configured to extend from the first opening into an inside of the body and guide air from outside into the engine room. In this construction, the air being taken in through the opening can be guided smoothly into the engine room.

A filter may be provided in the air-guiding passage and configured to separate substances from the air flowing within the air-guiding passage to remove the substances. More often than not, the air being taken into the body contains water such as water spray, or substances such as dust and insects, which are undesirable to the engine. The filter is capable of suitably separating the substances from the air being guided into the body.

The filter may be comprised of a separating plate configured to protrude inward within the air-guiding passage to separate water from the air flowing within the air-guiding passage, a tank that contains the separated water, and a drain configured to discharge the water within the tank. With such a relatively simple structure, the water can be separated from the air being guided into the body and removed.

An opening end portion of the air-guiding passage may be configured to open upward toward an inside of the engine room. In this structure, the air flows upward in the vicinity of the end portion of the air-guiding passage on the engine room side. Since the water contained in the air is heavier than the air, the water is less likely to flow upward. Thus, the water is inhibited from entering the engine room.

An openable valve may be provided in the air-guiding passage and configured to control a flow of the air flowing within the air-guiding passage. By opening the openable valve, a desired amount of air can be taken into the engine room, whereas by closing the openable valve, the water or other substances can be inhibited from entering the engine room.

The openable valve may be opened when an engine speed of the engine is not less than a predetermined valve. More specifically, when the watercraft is traveling with a high engine speed, which is not less than (i.e. equal to or above) a predetermined value, the openable valve is opened, whereas, when the watercraft is traveling with a low engine speed, which is not more than the predetermined valve, the openable valve is closed. By opening the openable valve during high-speed travel that requires a large amount of air, the engine can obtain sufficient taken-in air, whereas, by closing the openable valve during low-speed travel that requires a relatively small amount of air, the water is inhibited from entering the engine room.

When the watercraft is traveling at a high speed, and is skipping along the surface of the water (i.e. repeatedly jumping out of and landing in the water), water spray flies toward the body, and therefore, a relatively small amount of water enters the engine room with the openable valve opened. On the other hand, when the watercraft is traveling at a low speed, water splashes toward the front end portion of the body, and a large amount of water might enter the engine room with the openable valve opened. So, the configuration for operating the openable valve based on the engine speed is useful to the watercraft.

The openable valve may be driven based on a throttle-open position or a travel speed, instead of or in addition to the engine speed. When the throttle is fully closed to cause the engine speed to be reduced, and to thereby cause the ship speed to be reduced substantially abruptly, the body tends to be inclined forward and downward and water splashes the front end portion of the body. Such an abrupt reduction in the ship speed can be judged based on the engine speed, the throttle-open position, and the travel speed. Therefore, by opening the openable valve to allow a large amount of air to be guided into the engine room during high-speed travel, whereas, when the ship speed is abruptly reduced, this is detected and the openable valve is closed, thereby inhibiting the water from entering the engine room.

The openable valve may be opened and closed based on difference in air pressure between the inside of the body and the outside of the body. Since the amount of taken-in air is larger with the engine operating at a high speed than with the engine operating at a low speed, the engine room tends to have a negative pressure. So, by opening the openable valve when the engine room has a negative pressure relative to the outside of the body, it is possible to avoid a deficiency in the taken-in air supplied to the engine. A pressure sensor may be provided to detect an air pressure. Also, a lead valve may be provided as the openable valve and configured to be mechanically driven to open and close based on the pressure difference between the inside of the engine room and the outside of the watercraft.

The openable valve may be closed when the body is inverted. Thereby, by closing the openable valve when the body is inverted with the openable valve opened, it is possible to inhibit the water from entering the engine room.

The above and further objects and features of the invention will more fully be apparent from the following detailed description with accompanying drawings.

DETAILED DESCRIPTION OF THE PREFERRED EMBODIMENTS

Hereinafter, embodiments of a personal watercraft of the present invention will be described with reference to the accompanying drawings.

Embodiment 1

Figure 1:
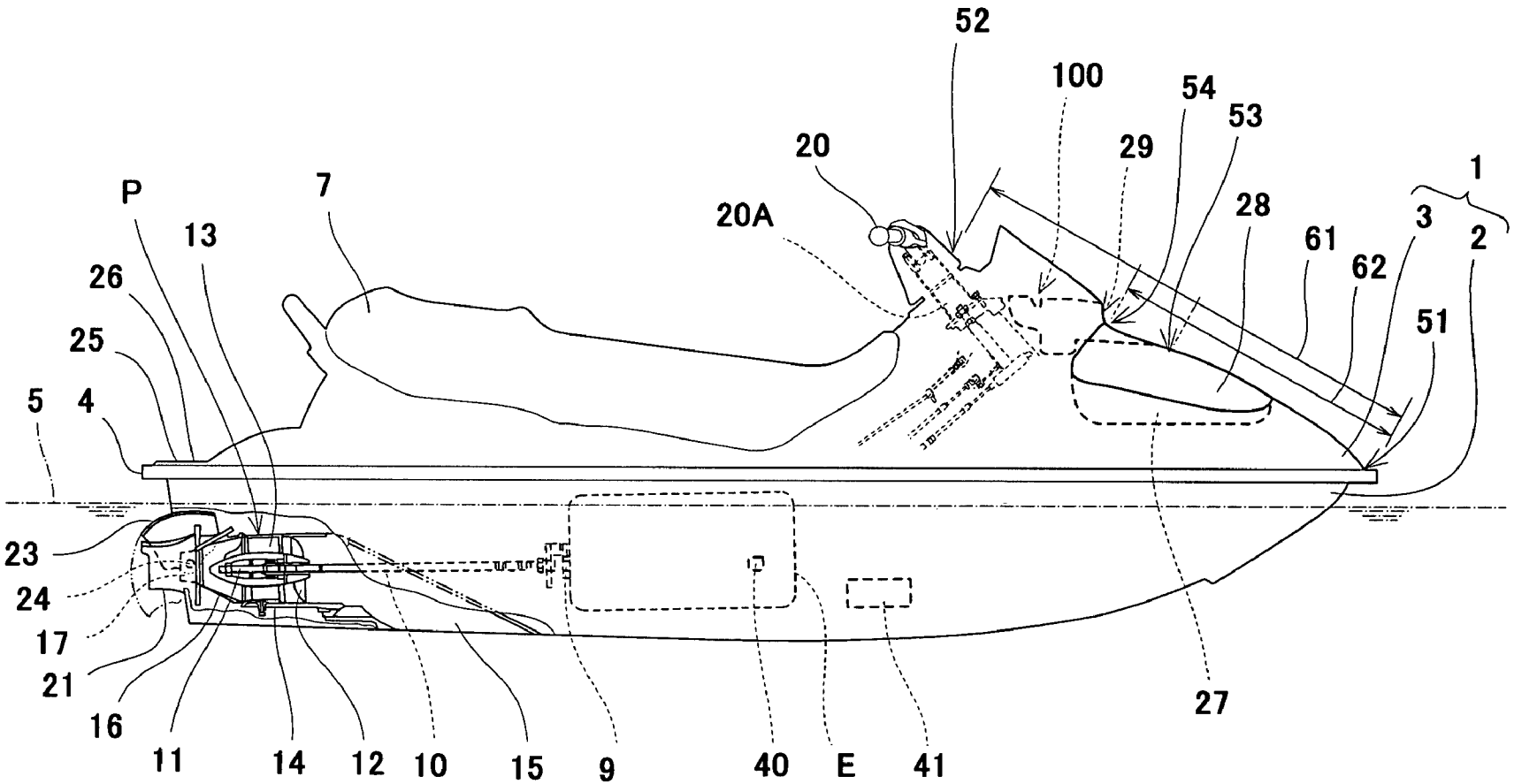
FIG. 1 is a side view of a water-jet propulsion personal watercraft according to an embodiment of the present invention.

The personal watercraft in FIG. 1 is a straddle-type personal watercraft provided with a seat 7 straddled by a rider. A body 1 of the watercraft comprises a hull 2 and a deck 3 covering the hull 2 from above. A line at which the hull 2 and the deck 3 are connected over the entire perimeter thereof is called a gunnel line 4. In this embodiment, the personal watercraft is constructed such that a waterline 5 in a certain condition of the watercraft is located below the gunnel line 4.

Figure 2:
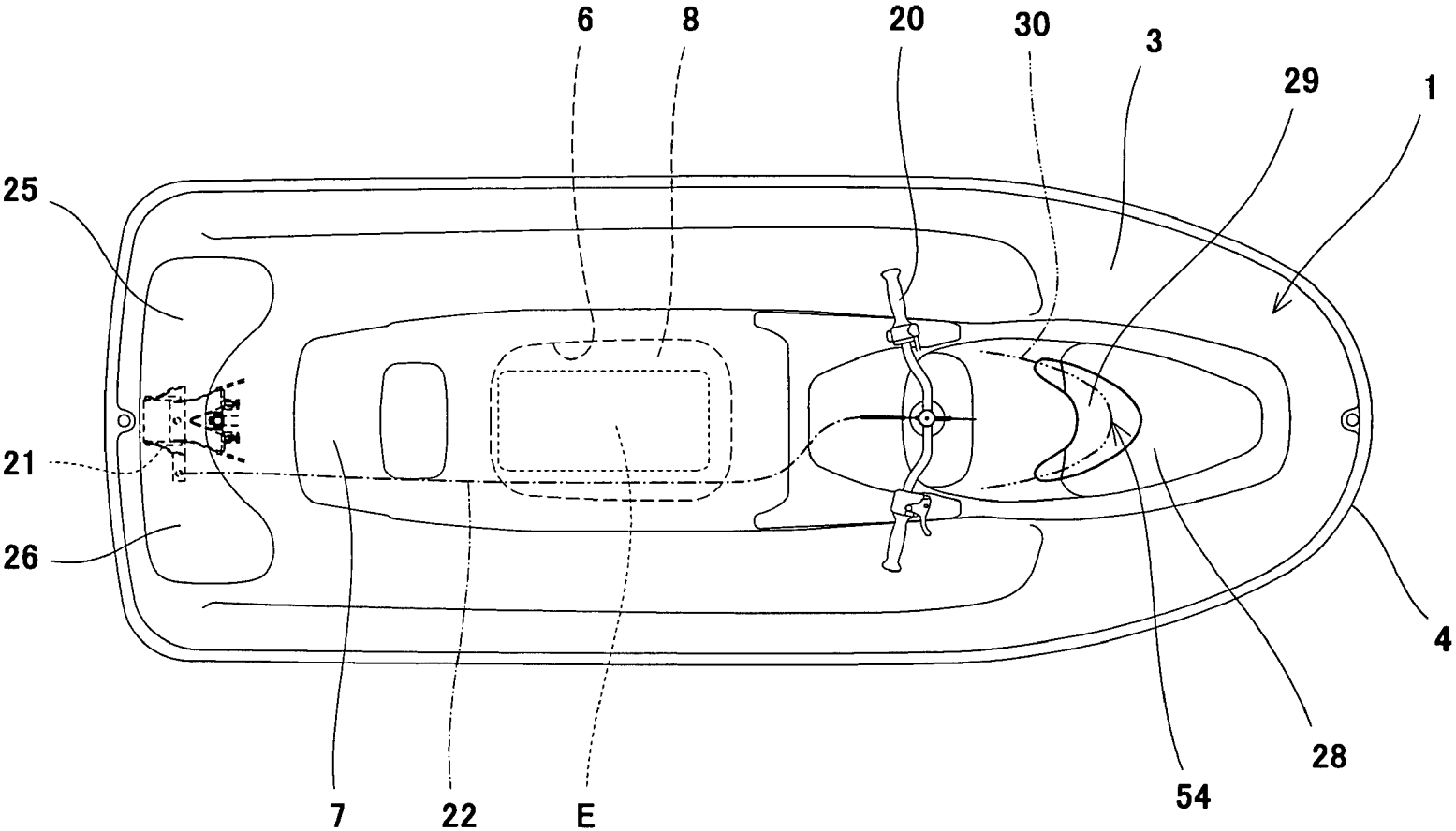
FIG. 2 is a plan view of the personal watercraft in FIG. 1.

As shown in FIG. 2, an opening 6, which has a substantially rectangular shape as seen from above, is formed at a substantially center section of the deck 3 in the upper portion of the body 1 such that its longitudinal direction corresponds with the longitudinal direction of the body 1. The seat 7 is removably mounted over the opening 7.

An engine room 8 is provided in a space defined by the hull 2 and the deck 3 below the opening 6. An engine E is mounted within the engine room 8 and configured to drive the watercraft. The engine room 8 has a convex-shaped transverse cross-section and is configured such that its upper portion is smaller than its lower portion. In this embodiment, the engine E is an in-line four-cylinder four-cycle engine.

As shown in FIG. 1, the engine E is mounted such that a crankshaft 9 extends along the longitudinal direction of the body 1. Air within the engine room 8 is supplied to the engine E within the engine room 8 through an air-intake system (not shown) of the engine E. A crank position sensor 40 is attached to the engine E and configured to detect a rotational angle of the crankshaft 9. The signal detected by the crank position sensor 40 is transmitted to an ECU (electric control unit) 41 equipped in the body 1. Thus, the ECU 41 obtains the rotational angle and the number of rotations of the crankshaft 9.

In addition to the crank position sensor 40, the watercraft is provided with a throttle position sensor configured to detect an open position of a throttle that controls the amount of air taken into the engine E, a ship speed sensor configured to detect a travel speed of the body 1, and the like.

An output end of the crankshaft 9 is rotatably coupled integrally with a pump shaft 11 of a water jet pump P provided on the rear side of the body 1 through a propeller shaft 10. An impeller 12 is attached to the pump shaft 11 of the water jet pump P. Fairing vanes 13 are provided behind the impeller 12. The impeller 12 is covered with a pump casing 14 on the outer periphery thereof.

A water intake 15 is provided on the bottom of the body 1. The water intake 15 is connected to the pump casing 14 through a water passage. The pump casing 14 is connected to a pump nozzle 16 provided on the rear side of the body 1. The pump nozzle 16 has a cross-sectional area that gradually reduces rearward, and an outlet port 17 is provided on the rear end of the pump nozzle 16.

Water outside the watercraft is sucked from the water intake 15 and fed to the water jet pump P. The water jet pump P pressurizes and accelerates the water, and the fairing vanes 13 guide water flow behind the impeller 12. The water is ejected through the pump nozzle 16 and from the outlet port 17 and, as the resulting reaction, the watercraft obtains a propulsion force.

A bar-type steering handle 20 is provided on the deck 3 to be located in front of the seat 7. The handle 20 is connected to a steering nozzle 21 provided behind the pump nozzle 16 through a cable 22 in FIG. 2. When the rider rotates the handle 20 clockwise or counterclockwise, the steering nozzle 21 is swung toward the opposite direction so that the ejection direction of the water being ejected through the pump nozzle 16 can be changed, and the watercraft can be correspondingly turned to any desired direction while the water jet pump P is generating the propulsion force.

As shown in FIG. 1, a bowl-shaped reverse deflector 23 is provided on the rear side of the body 1 and on an upper portion of the steering nozzle 21 such that it can vertically swing around a horizontally mounted swinging shaft 24. When the deflector 23 is swung downward to a lower position around the swinging shaft 24 so as to be located behind the steering nozzle 21, the water being ejected rearward from the steering nozzle 21 is ejected substantially forward. As the resulting reaction, the personal watercraft moves rearward.

In FIG. 1, a rear deck 25 is provided in the rear section of the body 1. The rear deck 25 is provided with an openable rear hatch cover 26. A rear compartment with a small capacity is provided under the rear hatch cover 26. A front compartment 27 is provided in a front section of the deck 3 and located in front of the handle 20. The front compartment 27 is formed by recessing the deck 3 inward (downward) and has a predetermined volume. A front hatch cover 28 is openably attached over an entrance of the front compartment 27.

As shown in FIG. 1, an opening 29 is provided at a predetermined position of the front section of the deck 3 to allow air to be guided from the outside into the engine room 8. The opening 29 is an upstream end opening of an air-guiding system 100 configured to guide ambient air into the engine room 8. Hereinafter, "upstream" and "downstream" are defined from the perspective of a flow passage of the air.

Hereinbelow, the opening 29 will be described in detail. As shown in FIG. 1, a front end portion of the body 1 is located at a front position 51, a base portion of the handle 20, i.e., a portion of handle shaft 20A where the handle 20 intersects an upper surface of the deck 3, is located at a rear position 52, and a substantially center portion between the positions 51 and 52 is located at a center position 53. The opening 29 is provided at a position 54 which is defined between the rear position 52 and the center position 53. In other words, assuming that a distance between the front position 51 and the rear position 52 is a first distance 61 and a distance between the front position 51 and the position 54 of the opening 29 is a second distance 62, the second distance 62 is equal to or longer than half of the first distance 61. Therefore, the opening 29 is located in a substantially upper portion of the watercraft.

As shown in FIG. 2, the opening 29 extends laterally along an upper surface of the deck 3. More specifically, the opening 29 extends laterally relative to the body 1 along a horizontal cross-section 30 of the deck 3 including the position 54. The opening 29 is sized such that its width is larger than its height in an opening area to increase the opening area. And, the opening 29 is configured such that its edge portion conforms in shape to the upper surface of the deck 3.

Figure 3:
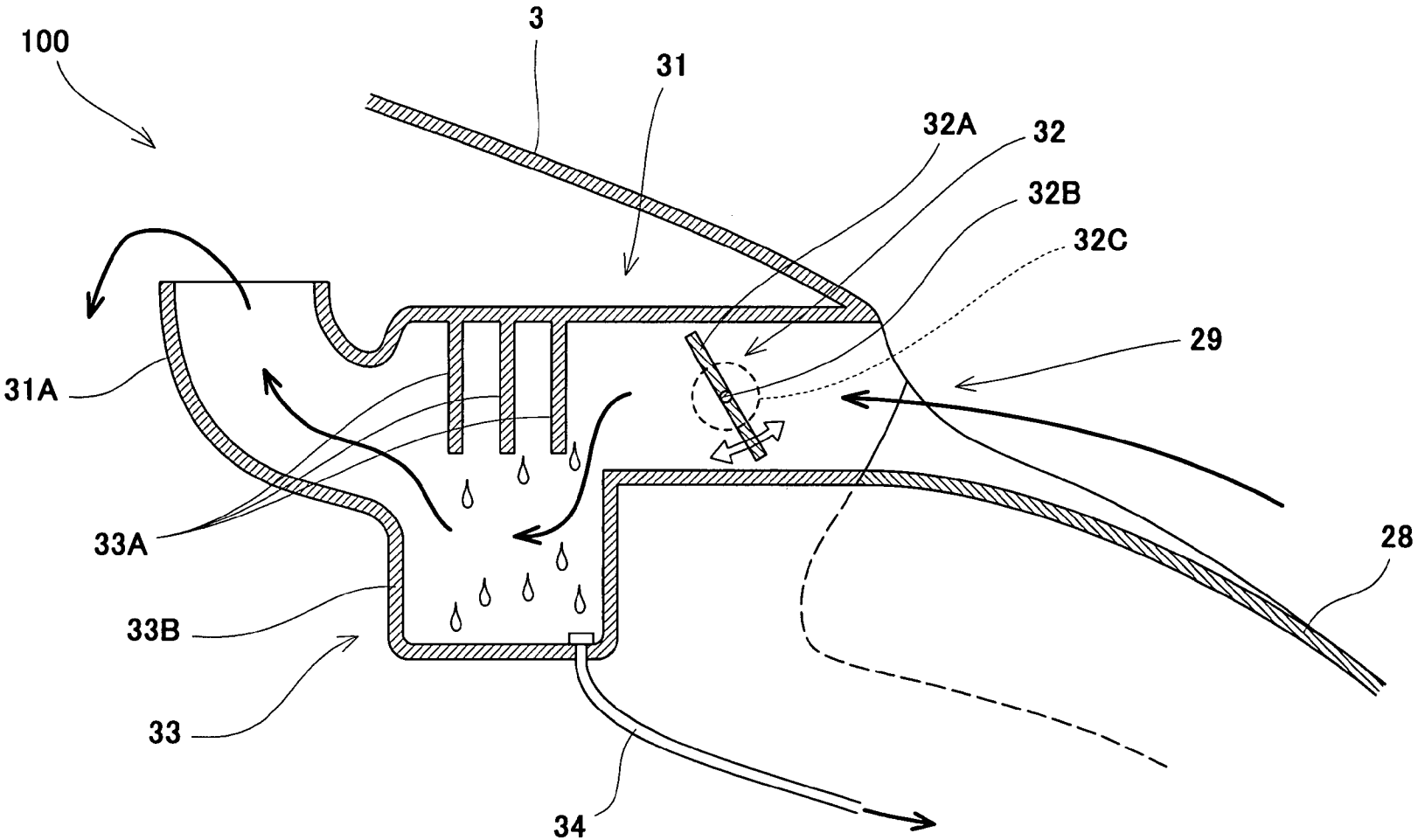
FIG. 3 is a partially enlarged cross-sectional view of the personal watercraft, showing a configuration of an air-guiding system applicable to the personal watercraft in FIG. 1.

Referring to FIG. 3, the air-guiding system 100 comprises an air-guiding pipe 31, a butterfly valve 32 as an openable valve of the air-guiding pipe 31, and a filter 33 configured to separate water from air, in addition to the opening 29.

As shown in FIG. 3, the air-guiding pipe 31 extends rearward from the opening 29 inside the body 1. A lower portion of the opening 29, i.e., a portion connecting the upper surface of the deck 3, which is located in front of the opening 29 to an inner surface of a lower portion of the air-guiding pipe 31, is tapered. Specifically, to allow the air flowing from forward of the watercraft to be smoothly guided, the inner surface of the lower portion of the air-guiding pipe 31 is curved forwardly and downwardly and connected to the upper surface of the deck 3. The butterfly valve 32 is provided in the air-guiding pipe 31. A downstream end portion of the air-guiding pipe 31 (end portion on the engine room 8 side) is curved upward and opens within the engine room 8.

The butterfly valve 32 comprises a plate-shaped valve plug 32A having substantially the same shape as a transverse cross-section of the air-guiding pipe 31. The valve plug 32A is fixed to a valve stem 32B having a center axis extending laterally along the center of the transverse cross-section of the air-guiding pipe 31 and rotatably supported by the air-guiding pipe 31. A rotational shaft of a power-driven motor 32C is connected to the valve stem 32B. The power-driven motor 32C transmits a power to the valve plug 32A through the valve stem 32B to cause the valve plug 32A to turn within the air-guiding pipe 31. This causes a flow passage within the air-guiding pipe 31 to be opened and closed, thereby controlling a flow rate of air. A drive circuit (not shown) is electrically connected to the ECU 41 (FIG. 1) and configured to drive the power-driven motor 32C. In accordance with an instruction signal from the ECU 41, the power-driven motor 32C causes the valve plug 32A to turn to a predetermined position.

An operation of the butterfly valve 32 will be described. The ECU 41 calculates an engine speed of the engine E based on a signal detected by the crank position sensor 40 (FIG. 1). And, when judging that the personal watercraft is in an idling state, or the personal watercraft is traveling at an engine speed that is not more than a predetermined value, the ECU 41 is configured not to drive the power-driven motor 32C, and as shown in FIG. 3, the butterfly valve 32 closes the flow passage of the air-guiding pipe 31 with a slight gap.

Subsequently, when the ECU 41 judges that the engine E is operating at a high speed that is not less than the predetermined value, the ECU 41 outputs an instruction signal to cause the power-driven motor 32C to be driven. Thereby, the valve plug 32A of the butterfly valve 32 turns to open the flow passage. As a result, the air being taken in through the opening 29 is guided into the engine room 8 through the air-guiding pipe 31.

A filter 33 is provided at a position of the air-guiding pipe 31 to be located downstream of the butterfly valve 32. The filter 33 serves to separate water from the air being taken in through the opening 29. The filter 33 is comprised of separating plates 33A configured to separate the water from the air and a water tank 33B serving as an expansion chamber and a water reserving chamber.

The separating plates 33A are configured to protrude downward from the inner surface of the air-guiding pipe 31 and to be spaced apart from one another, thus forming a labyrinth structure in part of the air-guiding pipe 31. The air containing a water mist, flowing within the air-guiding pipe 31, collides against wall faces of the separating plates 33A. Upon collision against the wall faces, the water mist forms droplets on the wall faces. Thus, the water is separated from the air.

The water tank 33B is formed to have a predetermined volume by downwardly recessing the wall portion of the air-guiding pipe 31 below the separating plates 33A. In this structure, since the air containing the water mist flows into the water tank 33B serving as the expansion chamber at a low speed, the water is separated from the air. And, the water separated from the air by the separating plates 33A and within the water tank 33B drops to a bottom portion of the tank 33B.

An end portion of a drain 34 is connected to a bottom portion of the tank 33 so as to communicate with an inner space of the tank 33 and the other end thereof opens outside of the body 1. And, the water remaining in the bottom portion of the tank 33 is discharged outside the body 1 through the drain 34 when the watercraft is, for example, beached.

In the personal watercraft constructed as described above, since the opening 29 extends laterally along the upper surface of the deck 3, the opening 29 has a relative large opening area for allowing a large amount of air to be smoothly taken into the body 1. Therefore, even when the engine E is operating at a high speed, the air sufficient to allow the engine E to properly operate can be obtained. Also, since the opening 29 is formed in the upper surface of the deck 3 such that the inner surface of the lower portion of the air-guiding pipe 31 is curved forwardly and downwardly and connected to the upper surface of the deck 3, the air flowing rearward from the front end portion toward the body 1 along the upper surface of the deck 3 can be guided smoothly to the opening 29.

By opening and closing the butterfly valve 32 provided in the air-guiding pipe 31 extending from the opening 29 into the engine room 8 as necessary, the air can be supplied appropriately to the engine E within the engine room 8. The butterfly valve 32 may be controlled to be opened and closed based on the engine speed of the engine E, or based on an open position of the throttle of the engine E, a ship speed, or an air pressure in the engine room 8.

The butterfly valve 32 can be controlled based on the open position of the throttle of the engine E in such a manner that, when the open position of the throttle is large, the butterfly valve 32 is greatly opened because the engine E is operating at a high speed, whereas when the open position of the throttle is small, the butterfly valve 32 is closed (or slightly opened) because the engine E is operating at a low speed.

The butterfly valve 32 can be controlled based on the ship speed in such a manner that, when the ship speed is high, the butterfly valve 32 is greatly opened because the engine E is operating at a high speed, whereas when the ship speed is low, the butterfly valve 32 closes (or slightly opens) because the engine E is operating at a low speed.

The butterfly valve 32 can be controlled based on the air pressure in such a manner that, when the air pressure within the engine room 8, which is detected by a pressure sensor, is lower than the air pressure (atmospheric pressure) outside the watercraft, the butterfly valve 32 is opened. In this case, when the engine room 8 has a negative pressure due to a deficiency under the condition in which the engine E is operating at a high speed and hence requires a larger amount of taken-in air, the negative pressure is detected and the butterfly valve 32 is opened, thereby allowing the air to be guided into the engine room 8 in appropriate amount. This makes it possible to inhibit the pressure within the engine room 8 from becoming negative due to a deficiency of air, and to supply sufficient air to the engine E.

A sensor for detecting inversion of the body 1 may be attached to the body 1. When the ECU 41 detects that the body 1 has been inverted, based on the signal from this sensor, the power-driven motor 32C may be driven in accordance with an instruction from the ECU 41. In this case, when the watercraft is inverted, the butterfly valve 32 can be closed. Therefore, when the watercraft is inverted, a large amount of water is inhibited from flowing into the engine room 8.

The filter 33 provided in the air-guiding pipe 31 extending rearward from the opening 29 enables the water to be separated from the air flowing through the opening 29. And, the separated water is guided to the tank 33B, and is thereafter discharged outside the watercraft through the drain 34.

The structure of the filter 33 is not limited to that shown in FIG. 3. For example, a plate member of a slit shape or a mesh shape may be provided within the air-guiding pipe 31. Such a structure makes it possible to remove substances flowing together with the air as well as separate the water from the air.

Embodiment 2

Figure 4:
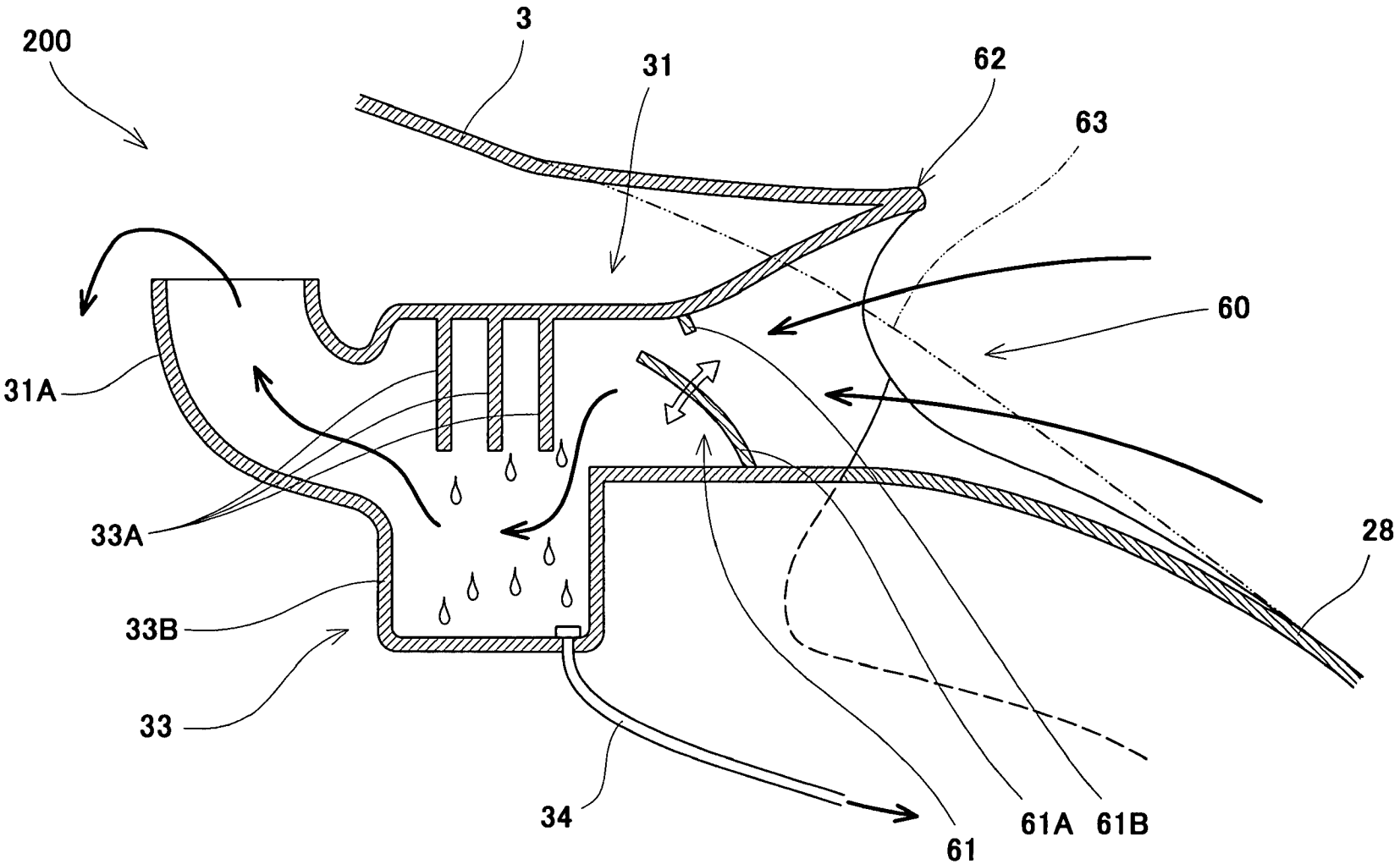
FIG. 4 is a partially enlarged cross-sectional view of the personal watercraft, showing another configuration of the air-guiding system applicable to the personal watercraft in FIG. 1.

Referring to FIG. 4, an air-guiding system 200 having another configuration will be described. The air-guiding system 200 in FIG. 4 comprises an opening 60, an air-guiding pipe 31, a lead valve 61 as an openable valve, a filter 33, and the like.

In the air-guiding system 200 in FIG. 4, the opening 60 and the lead valve 61 replace the opening 29 and the butterfly valve 32 included in the air-guiding system 100 in FIG. 3. Therefore, hereinbelow, the opening 60 and the lead valve 61 will be described. The air-guiding system 200 is applicable to the personal watercraft in FIGS. 1 and 2.

As shown in FIG. 4, the air-guiding pipe 31 extends rearward from the opening 60 inside the body 1. A lower portion of the opening 60, i.e., a portion connecting the upper surface of the deck 3 which is located in front of the opening 60 to the inner surface of the lower portion of the air-guiding pipe 31 is curved forwardly and downwardly as in the structure shown in FIG. 3. A protruding portion 62 having an upper edge portion of the opening 60 is shaped to protrude forward and upward from the upper surface of the deck 3, as seen in a side view. More specifically, the protruding portion 62 is configured to protrude outward more than an imaginary line 63 of the upper surface of the deck 3, which extends rearward from a front position of the opening 60.

The lead valve 61 is provided in the air-guiding pipe 31. The lead valve 61 is comprised of a plate-shaped valve plug 61 A having proper elasticity and a stopper 61B. The valve plug 61A is configured such that a base end portion is attached to an inner wall of the lower portion of the air-guiding pipe 31 and a tip end portion is swingable in a flow direction of the air (longitudinal direction of the body 1). The stopper 61B serves to restrict a forward swing of the tip end portion of the valve plug 61A from a predetermined position. That is, the lead valve 61 is a one-way valve that permits only a flow of the air toward an inside of the engine room 8 within the air-guiding pipe 31.

In the personal watercraft comprising the air-guiding system 200 constructed as described above, the protruding portion 62 protruding outward enables a larger amount of air to be guided into the opening 60, and hence, a larger amount of air can be guided efficiently into the engine room 8.

When the engine E is operating at a high speed and the air pressure within the engine room 8 becomes lower than that outside the body 1, the tip end portion of the valve plug 61A swings toward the inside of the body 1, so that the air can be taken in from outside into the engine room 8. In addition, when the personal watercraft is traveling at a high speed, the lead valve 61 is opened by a wind pressure from forward of the watercraft, so that sufficient air can be supplied to the engine E operating at a high speed.

On the other hand, when the engine E is operating at a low speed, and there is a slight difference between the air pressure outside the body 1 and the air pressure within the engine room 8, the lead valve 61 is closed, thereby inhibiting the water from entering the engine room 8. In addition, when the personal watercraft is traveling at a low speed, the wind pressure from forward of the watercraft is relatively low, so that the lead valve 61 is closed and, therefore, the water is inhibited from entering the engine room 8 while the watercraft is traveling in choppy water.

Water droplets on the surface of the deck 3, which is located in front of the opening 60, might move along the surface of the deck 3 due to the wind pressure during travel. However, since the lead valve 61 is vertically provided such that the base end portion of the valve plug 61A is attached to the inner wall of the lower portion of the air-guiding pipe 31, it is possible to inhibit such water droplets from flowing into the engine room 8.

Embodiment 3

Figure 5:
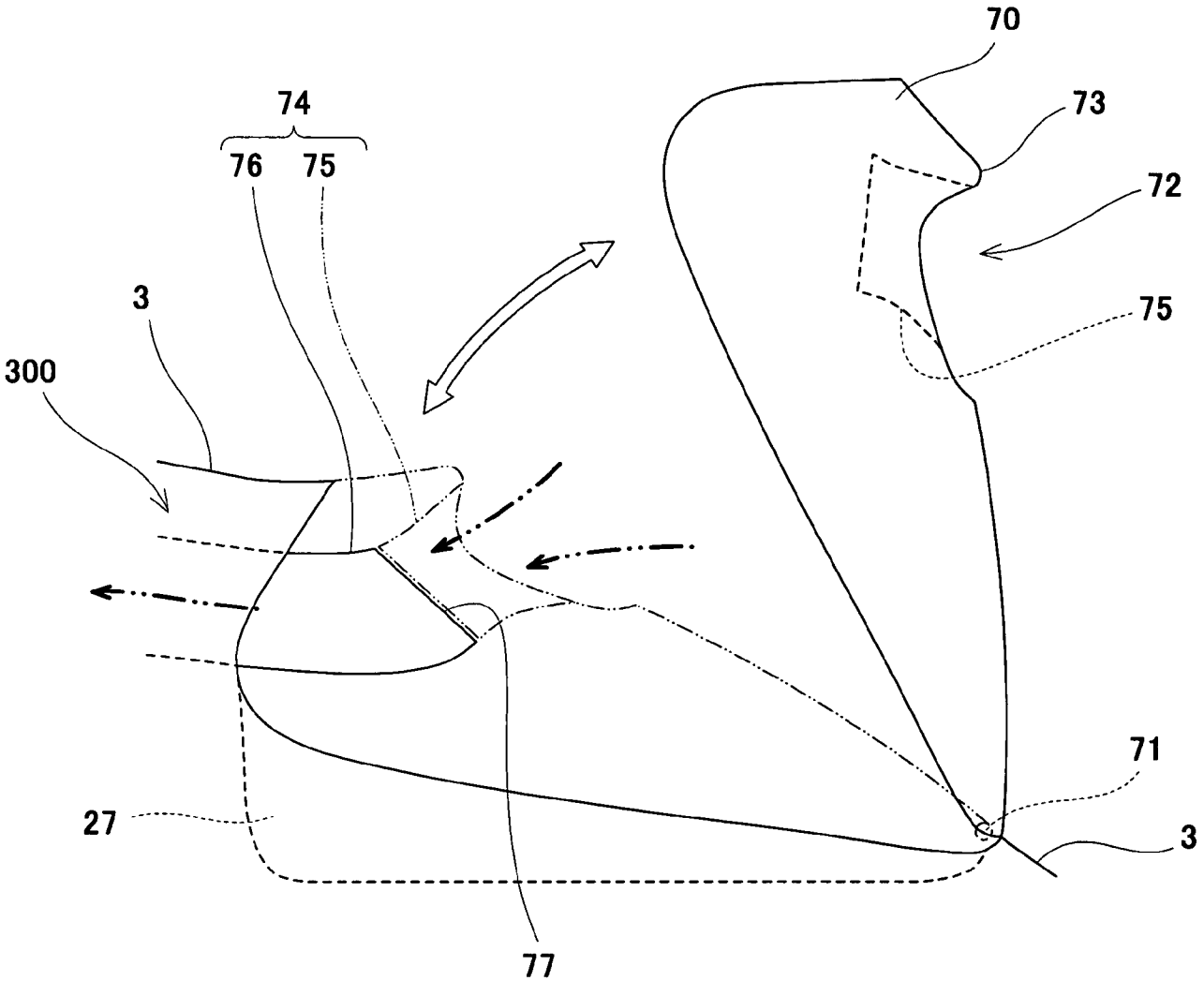
FIG. 5 is a partial side view of the personal watercraft showing another configuration of the air-guiding system applicable to the personal watercraft in FIG. 1.

FIG. 5 is a partial side view of an air-guiding system 300 configured to penetrate a compartment 27 provided in the front portion of the deck 3 and a hatch cover 70 that covers an entrance to the compartment 27. The air-guiding system 300 is applicable to the personal watercraft in FIGS. 1 and 2.

As shown in FIG. 5, the hatch cover 70 is mounted pivotally around a pivot axis 71 on the deck 3. By pivoting the hatch cover 70 around the pivot axis 71, the entrance of the compartment 27 is opened and closed. A first opening 72 is provided in the hatch cover 70. A protruding portion 73 is provided on an upper edge portion of the first opening 72 to protrude forward and upward, as seen in a side view.

An air-guiding pipe 74 extends from the first opening 72 to an inside of the engine room 8. The air-guiding pipe 74 is comprised of a first air-guiding pipe 75 provided in the hatch cover 70 and located forward and a second air-guiding pipe 76 provided in the deck 3 and located rearward. The first and second air-guiding pipes 74 and 75 are connected to each other in the vicinity of the first opening 72. And, a front end opening of the second air-guiding pipe 76 forms a second opening 77. When the hatch cover 70 is pivoted downward to close the compartment 27, the front end opening of the second guiding pipe 76 conforms in shape to a rear end opening of the first air-guiding pipe 75. As a result, an inside of the first air-guiding pipe 75 communicates with an inside of the second air-guiding pipe 76. Also, a lower portion of the first opening 72 is tapered as in the opening 29 in FIG. 3. In other words, an inner surface of a lower portion of the first air-guiding pipe 75 is curved forwardly and downwardly and connected to the upper surface of the hatch cover 70 which is located in front of the first opening 72.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A water-jet propulsion personal watercraft comprising:

a body including a hull and a deck covering the hull from above, the body being configured to form an engine room inside thereof in which an engine is mounted, and the deck being provided with a first opening configured to guide air from outside into the engine room;

a steering handle provided on an upper portion of the body, the steering handle including a steering shaft having a base portion where the steering shaft intersects an upper surface of the deck; and a protruding portion configured to protrude forward and upward from an upper surface of a portion of the deck which is located forward of the base portion of the steering handle;

wherein the first opening is provided on the upper surface of the deck at a position defined between the base portion of the steering shaft and a substantially center position between a front end portion of the body and the base portion of the steering shaft; and wherein the first opening is configured to open forward and has an upper edge portion which is formed by a front portion of the protruding portion.

2. The water-jet propulsion personal watercraft according to claim 1, wherein the first opening is configured to extend laterally and horizontally relative to the body and is shaped such that its width is larger than its height.

3. A water-jet propulsion personal watercraft comprising:

a body including a hull and a deck covering the hull from above, the body being configured to form an engine room inside thereof in which an engine is mounted, and the deck being provided with a first opening configured to guide air from outside into the engine room;

a steering handle provided on an upper portion of the body, the steering handle including a steering shaft having a base portion where the steering shaft intersects an upper surface of the deck, wherein the first opening is provided on the upper surface of the deck at a position defined between the base portion of the steering shaft and a substantially center position between a front end portion of the body and the base portion of the steering shaft, a compartment and a cover are provided on a front portion of the deck, the compartment being formed by recessing the body inward, and the cover being attachable to open and close an entrance of the compartment, the first opening is provided on the cover, and a second opening is provided on the compartment, and configured to communicate with the first opening provided on the cover with the cover closed, to allow air flowing through the first opening to be guided into the engine room; and an air-guiding passage configured to extend from the first opening into an inside of the body through an inside of the compartment with the cover closed;

wherein the air-guiding passage is divided into a first air-guiding and a second air-guiding pipe at the location within the compartment;

wherein the first air-guiding pipe is located on an upstream side and is connected to the first opening of the cover;

wherein the second air-guiding pipe is located on a downstream side and is connected to the deck, the second air-guiding pipe being provided with the second opening on an upstream end portion thereof; and wherein a downstream end portion of the first air-guiding pipe is configured to be placed opposite to the upstream end portion of the second air-guiding pipe to allow respective inner spaces of the first and second air-guiding pipes to communicate with each other with the cover closed.

4. A water-jet propulsion personal watercraft comprising:

a body including a hull and a deck covering the hull from above, the body being configured to form an engine room inside thereof in which an engine is mounted, and the deck being provided with a first opening configured to guide air from outside into the engine room;

a steering handle provided on an upper portion of the body, the steering handle including a steering shaft having a base portion where the steering shaft intersects an upper surface of the deck; and an air-guiding passage configured to extend from the first opening into an inside of the body and to guide air from outside into the engine room;

wherein the first opening is provided on the upper surface of the deck at a position defined between the base portion of the steering shaft and a substantially center position between a front end portion of the body and the base portion of the steering shaft; and wherein the air-guiding passage includes a duct member configured to extend rearward from the first opening of the deck; and wherein an opening end portion of the air guiding passage is configured to open upward toward an inside of the engine room.

5. The water-jet propulsion personal watercraft according to claim 4, wherein a filter is provided in the air guiding passage and configured to separate substances from the air flowing within the air guiding passage to remove the substances.

6. The water-jet propulsion personal watercraft according to claim 5, wherein the filter is comprised of a separating plate configured to protrude inward within the air guiding passage to separate water from the air flowing within the air guiding passage, a tank that contains the separated water, and a drain configured to discharge the water within the tank.

7. The water-jet propulsion personal watercraft according to claim 4, wherein an openable valve is provided in the air guiding passage and configured to control a flow of the air flowing within the air guiding passage.

8. The water-jet propulsion personal watercraft according to claim 7, wherein the openable valve is opened when an engine speed of the engine is not less than idling engine speed.

9. The water-jet propulsion personal watercraft according to claim 7, wherein the openable valve is opened and closed based on difference in air pressure between inside of the body and outside of the body.

10. The water-jet propulsion personal watercraft according to claim 7, wherein the openable valve is closed when the body is inverted.

11. The water-jet propulsion personal watercraft according to claim 4, wherein the air-guiding passage extends horizontally rearward.

12. A water-jet propulsion personal watercraft comprising:

a body including a hull and a deck covering the hull from above, the body being configured to form an engine room inside thereof in which an engine is mounted, and the deck being provided with a first opening configured to guide air from outside into the engine room;

a steering handle provided on an upper portion of the body, the steering handle including a steering shaft having a base portion where the steering shaft intersects an upper surface of the deck; and an air-guiding passage configured to extend from the first opening into an inside of the body and to guide air from outside into the engine room:

wherein the first opening is provided on the upper surface of the deck at a position defined between the base portion of the steering shaft and a substantially center position between a front end portion of the body and the base portion of the steering shaft;

wherein the air-guiding passage includes a duct member configured to extend rearward from the first opening of the deck;

wherein an openable valve is provided in the air-guiding passage and configured to control a flow of the air flowing within the air-guiding passage; and wherein an open position of the openable valve is controlled based on an open position of a throttle of the engine.

13. A water-jet propulsion personal watercraft comprising:

a body including a hull and a deck covering the hull from above, the body being configured to form an engine room inside thereof in which an engine is mounted, and the deck being provided with a first opening configured to guide air from outside into the engine room;

a steering handle provided on an upper portion of the body, the steering handle including a steering shaft having a base portion where the steering shaft intersects an upper surface of the deck; and an air-guiding passage configured to extend from the first opening into an inside of the body and to guide air from outside into the engine room;

wherein the first opening is provided on the upper surface of the deck at a position defined between the base portion of the steering shaft and a substantially center position between a front end portion of the body and the base portion of the steering shaft;

wherein the air-guiding passage includes a duct member configured to extend rearward from the first opening of the deck;

wherein an openable valve is provided in the air guiding passage and configured to control a flow of the air flowing within the air guiding passage; and wherein an open position of the openable valve is controlled based on a vessel speed of the watercraft.

* * * * *